US006059677A

United States Patent [19]

Breshears

[11] Patent Number: 6,059,677

[45] Date of Patent: May 9, 2000

[54] TRACKING ARROW SYSTEM

[76] Inventor: Danny R. Breshears, P.O. Box 513, Antlers, Okla. 74523

[21] Appl. No.: 09/186,331

[22] Filed: Nov. 5, 1998

[51] Int. Cl.[7] ..... F42B 6/04

[52] U.S. Cl. ..... 473/581

[58] Field of Search ..... 473/578, 581, 473/FOR 216, FOR 218

[56] References Cited

U.S. PATENT DOCUMENTS

| | | | |
|---|---|---|---|
| 4,106,770 | 8/1978 | Gray | 473/581 |
| 4,182,327 | 1/1980 | Haley | 473/581 X |
| 5,183,259 | 2/1993 | Lyon | 473/581 |

*Primary Examiner*—John A. Ricci

[57] ABSTRACT

A tracking arrow system is disclosed. The system includes a standard aluminum hollow cylindrical arrow having a near end and a far end. The system also includes a nock coupled to the fletch end of the arrow with an orifice where the paint in the fletch end is released and a bow string tip. A plunger component is provided within the arrow to hold the paint before an impact forces the paint down the arrow and out the end of the arrow orifice after impact. A large spring rod is built into the plunger and supports the large bore spring. A large spring rod is provided with release catches. The large spring rod has a nut for attachment to the end of the large spring rod. A small spring rod is provided having a stop nut on one end. A small spring rod nut stop is also provided. A large bore spring is adapted to push the plunger into the paint when released. A small spring rod bracket is provided wherein the small spring rod bracket and the spring stop are fixed to a non-moving part. A small head spring is located between the small spring rod bracket and the head point. The spring is compressed by the head pushing it forward on impact, automatically recocking the head. Double release rods are provided having ends and the ends have small hooks.

1 Claim, 3 Drawing Sheets

TRACKING ARROW SYSTEM

BACKGROUND OF THE INVENTION

1. Field of the Invention

The present invention relates to a tracking arrow system and more particularly pertains to allowing a hunter to follow a paint trail to quickly locate hunted game.

2. Description of the Prior Art

The use of hunting arrows of known designs and configurations is known in the prior art. More specifically, hunting arrows of known designs and configurations heretofore devised and utilized for the purpose of assisting bow and arrow hunters through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,093,229 to Kelling discloses a Game Tracking Arrow. U.S. Pat. No. 4,726,594 to Benke discloses a Drug Injection System for Use With an Arrow. U.S. Pat. No. 4,378,781 to Shiflett discloses an Arrow Locating Device. U.S. Pat. No. 5,353,712 to Olson discloses a Marking Pellet Gun and Rigid, Fracturable Pellet Therefor. U.S. Design Pat. No. 314,416 to Rezmer discloss a Replaceable Blade Broadhead Arrow Tip. Lastly, U.S. Pat. No. 5,202,533 to Vandersteen discloses a Drug Injection Apparatus for an Animal.

While these devices fulfill their respective, particular objectives and requirements, the aforementioned patents do not describe tracking arrow systems as disclosed herein.

In this respect, the tracking arrow system according to the present invention substantially departs from the conventional concepts and designs of the prior art, and in doing so provides an apparatus primarily developed for the purpose of allowing a hunter to follow a paint trail to quickly locate hunted game.

Therefore, it can be appreciated that there exists a continuing need for a new and improved tracking arrow system which can be used for allowing a hunter to follow a paint trail to quickly located hunted game. In this regard, the present invention substantially fulfills this need.

SUMMARY OF THE INVENTION

In view of the foregoing disadvantages inherent in the known types of hunting arrows of known designs and configurations now present in the prior art, the present invention provides an improved tracking arrow system. As such, the general purpose of the present invention, which will be described subsequently in greater detail, is to provide a new and improved tracking arrow system and method which has all the advantages of the prior art and none of the disadvantages.

To attain this, the present invention essentially comprises a new and improved tracking arrow system to allow a hunter to follow a paint trail to quickly locate hunted game comprising a standard aluminum hollow cylindrical arrow about 36 inches in length having a near end and a far end. The system also includes a nock coupled to the fletch end of the arrow with an orifice where the paint in the fletch end is released and a bow string tip which steadies an arrow before shooting. Additionally included is a plunger component within the arrow to hold the paint before an impact forces the paint down the arrow and out the end of the arrow orifice after impact. A large spring rod is built into the plunger and supports the large bore spring. A large spring rod with release catches is provided. The large spring rod has a nut for attachment to the end of the large spring rod. The nut acts as a guide when in its cocked position with the large spring compressed and prevents the small spring rod from pulling out of the large spring when in its release position. A small spring rod has a stop nut on one end for stopping the small rod from pulling out of the large rod. A small spring rod nut stop is provided for holding the small spring rod from pulling out of the large spring rod. A large bore spring is adapted to push the plunger into the paint when released and the large bore spring has a diameter approximately the same size as the diameter of the bore in the shaft of the arrow. A small spring rod bracket is provided wherein the small spring rod bracket and the spring stop are fixed to a moving part. The small rod passes through and caps off on the opposite side. A small head spring is located between the small spring rod bracket and the head point and acts as a cocking spring for the point. The spring is compressed by the head pushing it forward on impact, automatically recocking the head. Double release rods with ends are provided, the ends having small hooks allowing for easy entry of the large spring rod nut during cocking. A head point is provided which is arrowhead manufactured for providing ease in assembly and allows all other parts to be installed in sequence prior to attaching the final head. Lastly provided is a head stop nut for placement over the head shaft and attachment to the aluminum arrow with threads.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved tracking arrow system which has all of the advantages of the prior art hunting arrows of known designs and configurations and none of the disadvantages.

It is another object of the present invention to provide a new and improved tracking arrow system which may be easily and efficiently manufactured and marketed.

It is further object of the present invention to provide a new and improved tracking arrow system which is of durable and reliable constructions.

An even further object of the present invention is to provide a new and improved tracking arrow system which is susceptible of a low cost of manufacture with regard to both materials and labor, and which accordingly is then susceptible of low prices of sale to the consuming public, thereby making such tracking arrow system economically available to the buying public.

Even still another object of the present invention is to provide a tracking arrow system for allowing a hunter to follow a paint trail to quickly located hunted game.

Lastly, it is an object of the present invention to provide a new and improved tracking arrow system including a standard aluminum hollow cylindrical arrow having a near end and a far end. The system also includes a nock coupled to the fletch end of the arrow with an orifice where the paint in the fletch end is released and a bow string tip. A plunger component is provided within the arrow to hold the paint before an impact forces the paint down the arrow and out the end of the arrow orifice after impact. A large spring rod is built into the plunger and supports the large bore spring. A large spring rod is provided with release catches. The large spring rod has a nut for attachment to the end of the large spring rod. A small spring rod is provided having a stop nut on one end. A small spring rod nut stop is also provided. A large bore spring is adapted to push the plunger into the paint when released. A small spring rod bracket is provided wherein the small spring rod bracket and the spring stop are fixed to a moving part. A small head spring is located between the small spring rod bracket and the head point. The spring is compressed by the head pushing it forward on impact, automatically recocking the head. Double release rods are provided having ends and the ends have small hooks.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
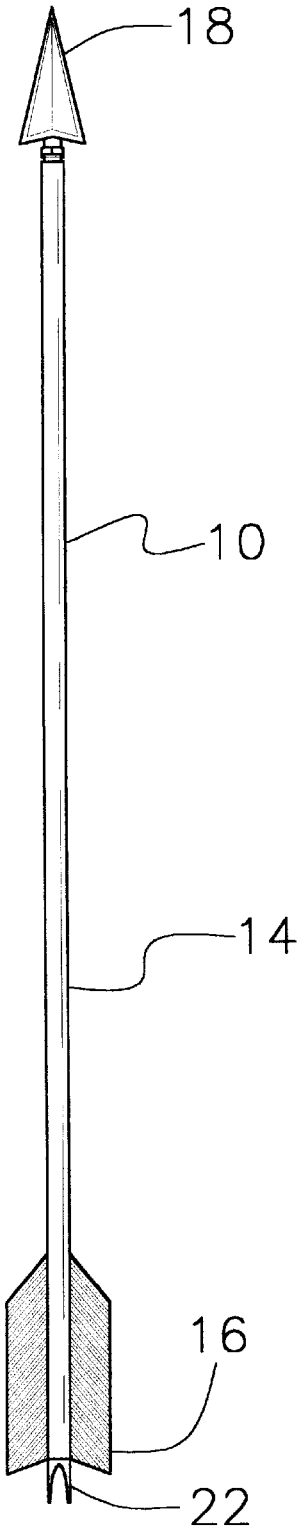
FIG. 1 is a side elevational view of the new and improved tracking arrow system constructed in accordance with the principles of the present invention.
Figure 2:
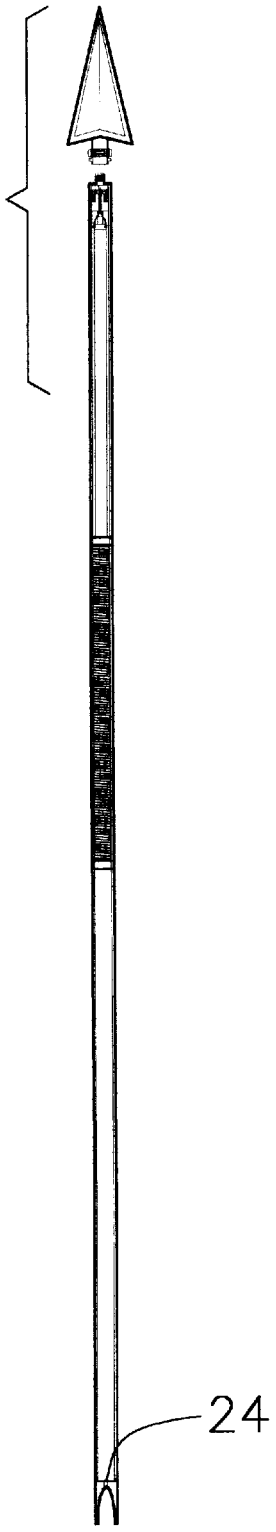
FIG. 2 is a cross-sectional view of the arrow shown in FIG. 1 but with the large spring compressed.
Figure 3:
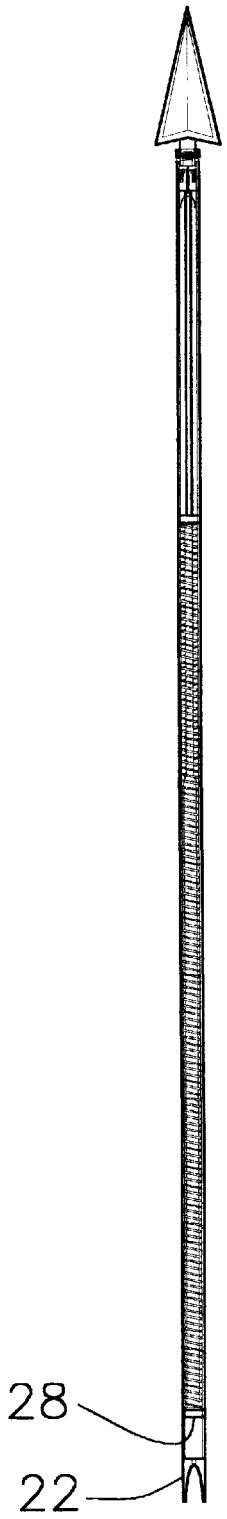
FIG. 3 is a view similar to FIG. 2 but with the large spring released.
Figure 4:
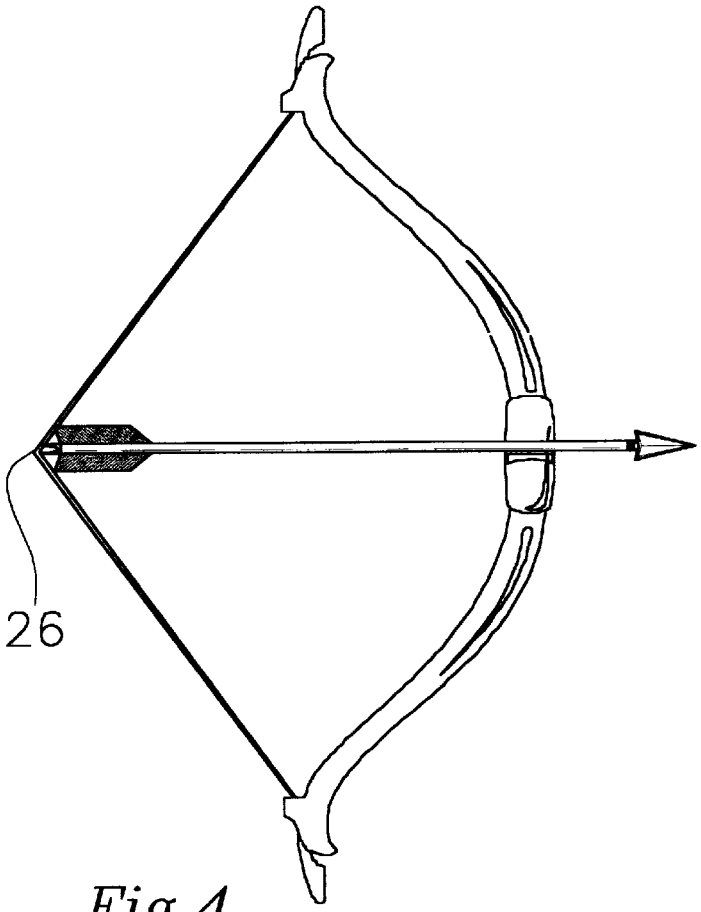
FIG. 4 is a side elevational view of the arrow shown in FIGS. 1 through 3 when supported on a bow.

With reference now to the drawings, and in particular to FIG. 1 thereof, the preferred embodiment of the new and improved tracking arrow system embodying the principles and concepts of the present invention and generally designated by the reference numeral 10 will be described.

The present invention, the tracking arrow system 10, is comprised of a plurality of components. Such components in their broadest context include a standard arrow, a plunger component, a large spring rod, a small spring rod and a large bore spring. Such components are individually configured and correlated with respect to each other so as to attain the desired objective.

As disclosed herein, the new and improved tracking arrow system 10 to allow a hunter to follow a paint trail to quickly locate hunted game comprises, in combination, a standard aluminum hollow cylindrical arrow 14 about 36 inches in length having a near end 16 and a far end 18.

Also provided is a nock 22 coupled to the fletch end of the arrow with an orifice 24 where the paint in the fletch end is released. A bow string tip 26 steadies an arrow before shooting.

Also provided is a plunger component 28 within the arrow to hold the paint before an impact forces the paint down the arrow and out the end of the arrow orifice after impact.

Additionally provided is a large spring rod 30 built into the plunger and supporting the large bore spring 32.

The large spring rod 30 has a nut 36 with release catches 37 attached at its end. The nut acts as a guide when the large spring rod is in its cocked position with the large bore spring compressed.

Further provided is a small spring rod 40 having a nut stop 42 on one end. The nut stop will contact the nut 36 for stopping the small rod from pulling out of the large rod.

The large bore spring 32 is adapted to push the plunger into the paint when released and has a diameter approximately the same size as the diameter of the bore in the shaft of the arrow.

Additionally provided is a small spring rod bracket stop 48 wherein the small spring rod bracket and the spring stop are fixed to a moving part 50. The small rod passes through and caps off on the opposite side.

A small head spring 52 is located between the small spring rod bracket and the head point 54. The small head spring acts as a cocking spring for the point and, being compressed by the head pushing it forward on impact, automatically recocks the head.

Double release rods having ends 56 are next provided. The ends have small hooks allowing for easy entry of the large spring rod nut during cocking.

The head point 54 is provided which is arrowhead manufactured for providing ease in assembly and allows all other parts to be installed in sequence prior to attaching the final head.

Lastly provided is a head stop nut 60 for placement over the head shaft. The stop nut attachs to the aluminum arrow with threads.

Figure 5:
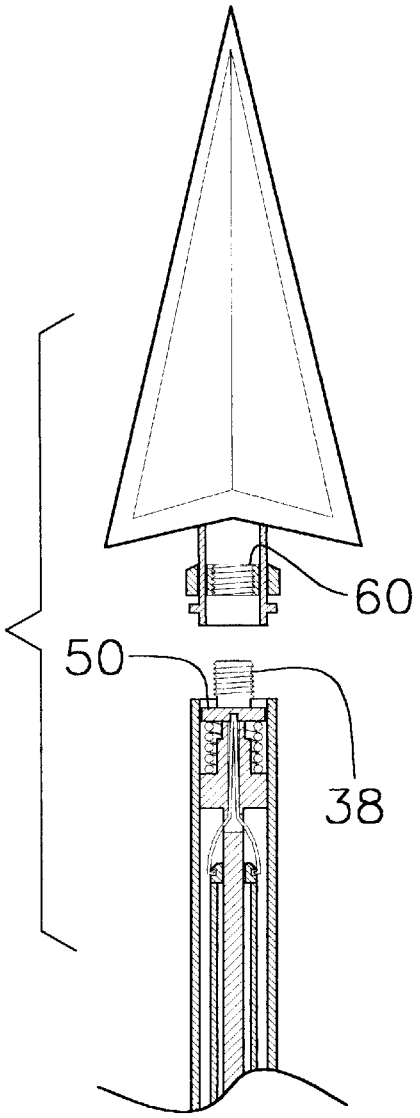
FIG. 5 is an enlarged end elevational view of the point end of the arrow shown in the prior Figures.
Figure 6:
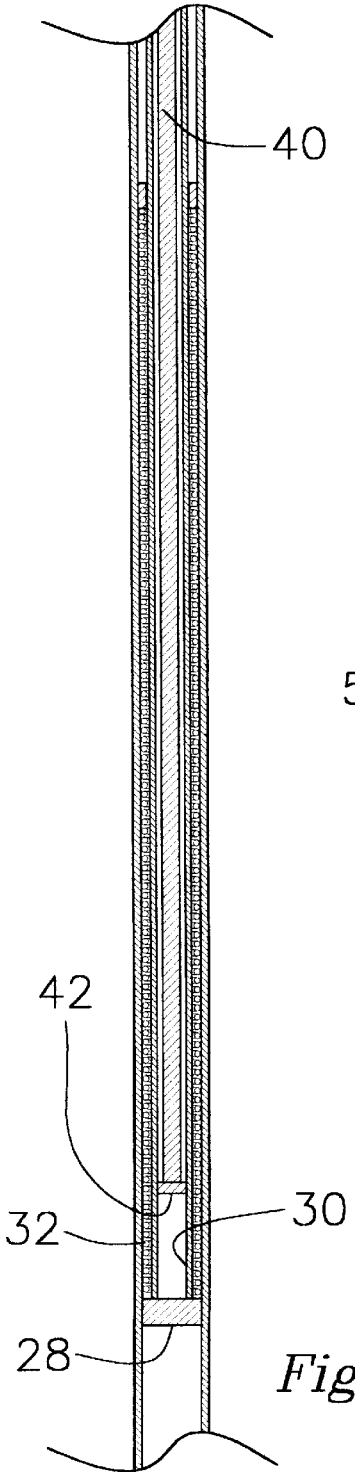
FIG. 6 is a cross-sectional view of the central segment of the arrow shown in the prior Figures.
Figure 7:
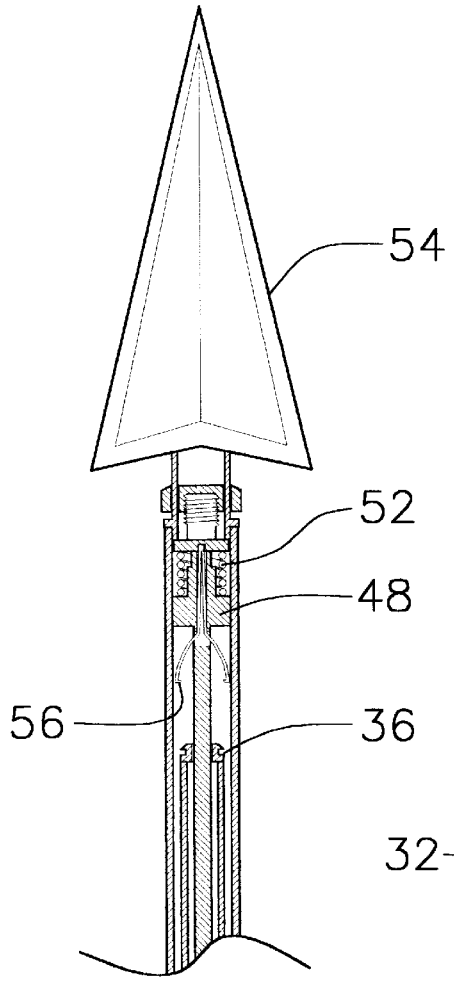
FIG. 7 is a view similar to FIG. 5 but with the arrow and point coupled.
Figure 8:
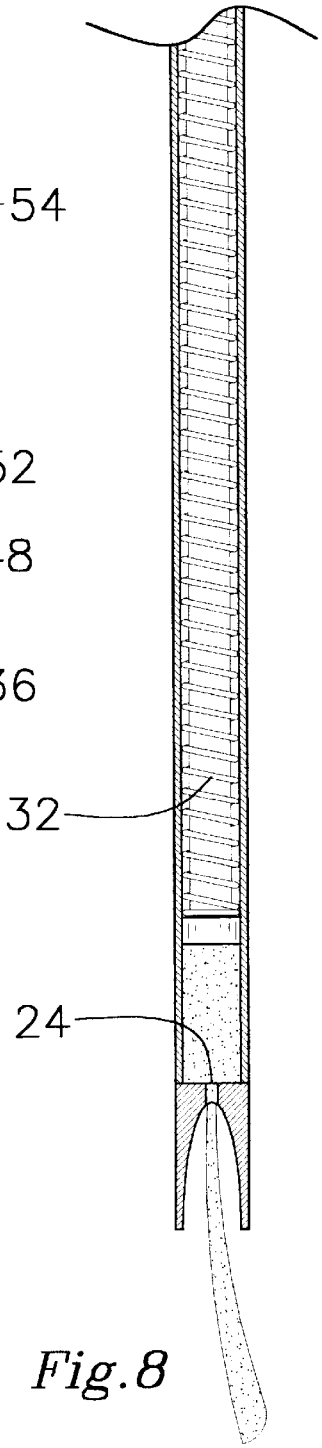
FIG. 8 is an enlarged cross-sectional view of the fletch end of the arrow illustrating paint being released.

As can be seen from the foregoing, the system includes a large exterior fixed cylinder, arrow 14, and a small interior fixed cylinder, small spring rod 40. Fixed bracket 48 is secured to the top of the small spring rod 40 and fixed nut stop 42 is secured to the bottom of rod 40. Between the arrow and the small spring rod is the intermediate cylindrical movable large spring rod 30. The movable large spring rod has release catches at the top and a plunger 28 at the bottom adapted to contact the paint and force it out through the orifice 24 upon impact. FIG. 5 shows the system prior to impact with the large spring rod held in the raised position by the contracted ends 56 of the release rods. FIG. 7 shows the system after impact with the large spring rod in the lower position after release by the expanded ends of the release rods 56. In FIG. 5, moving part 50 is raised to lift the release rods 56 due to the urging of spring 52. This cams inwardly the ends of the release rods 56 for coupling to the nut 36. After impact, movable part 50 pushes the release rods 56 downwardly through the opening 49 in bracket stop 48 whereby the ends of the release rods move outwardly to allow downward movement of the nut 36 and the large spring rod 30 under the urging of the large bore spring 32 to dispense paint. Note FIG. 7. The large bore spring 32, being in contact with the plunger component, urges the plunger component downwardly after impact with the upper end of the spring fixedly positioned by contacting a collar 64 fixedly secured to the inner surface of the hollow cylindrical arrow 14. In the alternative, the upper and of the large bore spring 32 could be in contact with the bracket stop 48 to effect the same desired result. The small head spring 52 has an upper end in contact with and movable with the movable part 50. The small head spring has a lower end in contact with and movable with the movable part 50. The small head spring has a lower end in contact with the fixedly positioned small spring rod bracket stop 48. The moving part 50 is positioned upwardly prior to impact but compresses upon impact to move the wishbone-shaped release rods downwardly and its ends 56 outwardly whereby the large bore spring may expand to drive out paint through the orifice upon movement of the plunger component.

The tracking arrow system of the present invention leaves a fluorescent trail to help hunters locate wounded game. The arrow has several component parts which act together in a way which is similar to the mechanism in a ball point pen. When the pressure is applied to the tip of the arrow, a large bore spring 32 is released which pushes a plunger 28 through the inside bore of the arrow and forces paint out the back of the arrow allowing the paint to drip onto the ground. This leaves a paint trail as the animal tries to escape.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A tracking arrow system to allow a hunter to follow a paint trail to quickly locate hunted game comprising:

a standard aluminum hollow cylindrical arrow having a near end and a far end;

a nock coupled to the near end of the arrow, and having an orifice through which the paint may be released;

a small spring rod disposed within the arrow and fixedly mounted to a bracket stop disposed at the far end of the arrow, the small spring rod extending partially toward the near end of the arrow, and having a stop nut at its near end; an annular space between the small spring rod and the walls of the arrow;

a large spring rod slidably disposed over the small spring rod in the annular space, the large spring rod having a plunger at its near end movable in the space between the near end of the small spring rod and the arrow nock; the large spring rod having a nut at its far end which is engageable with the stop nut to prevent the large spring rod from fully sliding off of the small spring rod, the nut of the large spring rod having exterior release catches;

a quantity of paint stored in the space between the plunger and nock;

a large bore spring disposed in the annular space, between a fixed collar and the plunger, for biasing the plunger toward the paint;

the far end of the arrow further including a head point, mounted to a moving part; a small head spring mounted between the bracket stop and moving part for biasing the head point toward the far end of the arrow;

release rods connected to the moving part and extending through an opening in the bracket stop and over a cam surface, the release rods having near ends engageable with the release catches of the nut of the large spring rod;

whereby, before the arrow hits a target, the near ends of the release catches are cammed inwardly to engage the nut to hold the large spring rod, and when the arrow hits a target, the head point pushes the moving part, which pushes the release rods, which are cammed outwardly, which releases the large spring rod to push the plunger into the paint which exits through the orifice.

* * * * *